United States Patent [19]

Sholly, Jr.

[11] 4,015,414

[45] Apr. 5, 1977

[54] MONITORED TWIST CONTROL APPARATUS AND METHOD

[75] Inventor: William C. Sholly, Jr., Souderton, Pa.

[73] Assignee: The Warner & Swasey Textile Machine Company, Gastonia, N.C.

[22] Filed: Feb. 20, 1975

[21] Appl. No.: 551,350

Related U.S. Application Data

[63] Continuation-in-part of Ser. No. 478,599, June 12, 1974, Pat. No. 3,994,123, which is a continuation-in-part of Ser. No. 405,036, Oct. 10, 1973, abandoned.

[52] U.S. Cl. ..... 57/34 HS; 57/77.4; 57/157 TS; 73/160; 57/1 R

[51] Int. Cl.² ..... D02G 1/02; D01H 13/32; G01L 5/00

[58] Field of Search ..... 57/34 HS, 1 R, 77.3–77.45, 57/157 TS, 34 B, 156; 73/158, 159, 160, 95.5

[56] References Cited

UNITED STATES PATENTS

| | | | |
|---|---|---|---|
| 3,405,556 | 10/1968 | Gonsalves et al. | 73/160 |
| 3,593,508 | 7/1971 | Jachimowicz | 57/34 R |
| 3,613,347 | 10/1971 | Carruthers | 57/1 R |
| 3,667,292 | 6/1972 | Hada | 73/160 |
| 3,685,273 | 8/1972 | Neveux | 57/77.4 |
| 3,705,487 | 12/1972 | Carruthers | 57/77.4 |
| 3,705,488 | 12/1972 | Sholly, Jr. et al. | 57/77.4 |
| 3,724,196 | 4/1973 | Holland et al. | 57/77.4 |
| 3,811,258 | 5/1974 | Batsch | 57/34 HS |
| 3,813,868 | 6/1974 | Lorenz | 57/77.4 |

*Primary Examiner*—John Petrakes
*Attorney, Agent, or Firm*—Paul & Paul

[57] ABSTRACT

A development is provided for monitoring twist on yarn being perferably friction twisted and for automatically adjusting the amount of twist being imparted to the yarn to compensate for a deviation in the amount of twist from that desired. The adjustment and monitoring may be effected on a position-to-position basis. Particularly novel monitoring developments are provided.

33 Claims, 14 Drawing Figures

MONITORED TWIST CONTROL APPARATUS AND METHOD

CROSS-REFERENCE TO RELATED APPLICATIONS

This is a continuation-in-part of my U.S. Application Ser. No. 478,599, filed June 12, 1974, now U.S. Pat. No. 3,994,123 directed to Friction Twisting Head, which, in turn, is a continuation-in-part of my U.S. Application Ser. No. 405,036, filed Oct. 10, 1973, directed to Friction Twisting Head On Conventional False Twisting Machines, now abandoned. The disclosure of Application Ser. No. 478,599, is herein incorporated by reference.

BACKGROUND OF THE INVENTION

This invention relates to apparatus and method for false twisting yarn, principally continuous multiplefilament synthetic yarn, such as to texturize or impart certain physical characteristics thereto. The type of apparatus to which the present invention in its broadest aspects is directed, usually involves heat setting of the false twist in the yarn, there often later being a removal of the false twist after a cooling of the yarn, such that the yarns take on a texturized, natural fibre appearance and character.

More particularly, this invention relates to multiple-station, or multiple-position twisting machines, wherein at each station there is provided friction twisting means.

My above-mentioned Application Ser. No. 478,599, directed to adjustments in the amount of twist being applied at the various twisting stations, particularly independent adjustment from station-to-station is additionally and especially enhanced by the present development of a monitoring apparatus and technique. This monitoring, as it allows for independent monitoring and automatic independent adjustment of the amount of twist at each station, on an independent station-to-station basis is particularly desirable.

More specifically, the particular monitoring technique of the present invention is a separate advance in itself. In U.S. Pat. to Carruthers No. 3,613,347, a needle type of monitor is disclosed. The present invention utilizes a particularly unique monitoring technique of great sensitivity and durability, allowing for sliding of yarn over a surface, as opposed to a blade, as well as incorporating ready readjustability features for a desired helix angle setting.

Accordingly, it is a primary object of the present invention to provide a novel monitoring technique and the apparatus therefor.

It is a further object of the present invention to provide a novel technique and apparatus for employing a monitor in conjunction with an adjustable twist-inducer, the latter being automatically responsive to the monitor.

It is another object of this invention to accomplish the above object, on a plurality of stations of a machine, whereby the monitoring and the adjustment is independent from station-to-station, or from position-to-position.

It is a further object of this invention to utilize a monitor as applied to friction twisting, to monitor the amount of twist, while employing sensitive switching techniques.

It is a further object of this invention to accomplish the above objects, wherein a magnetic switch is employed.

It is another object of this invention to provide apparatus and technique for enhancing yarn uniformity on a station-to-station basis, as it relates to twist being applied to yarn at those stations, and to do so at any given station independently of other stations.

It is a further object of this invention to provide a novel construction for a twist-inducing wheel in accordance with the present invention.

Other objects of the present invention will be readily apparent to those skilled in the art by reading the following brief descriptions of the drawings figures, detailed descriptions of the preferred embodiments, and the appended claims.

BRIEF DESCRIPTION OF THE DRAWING FIGURES

DETAILED DESCRIPTIONS OF THE PREFERRED EMBODIMENTS

Figure 1:
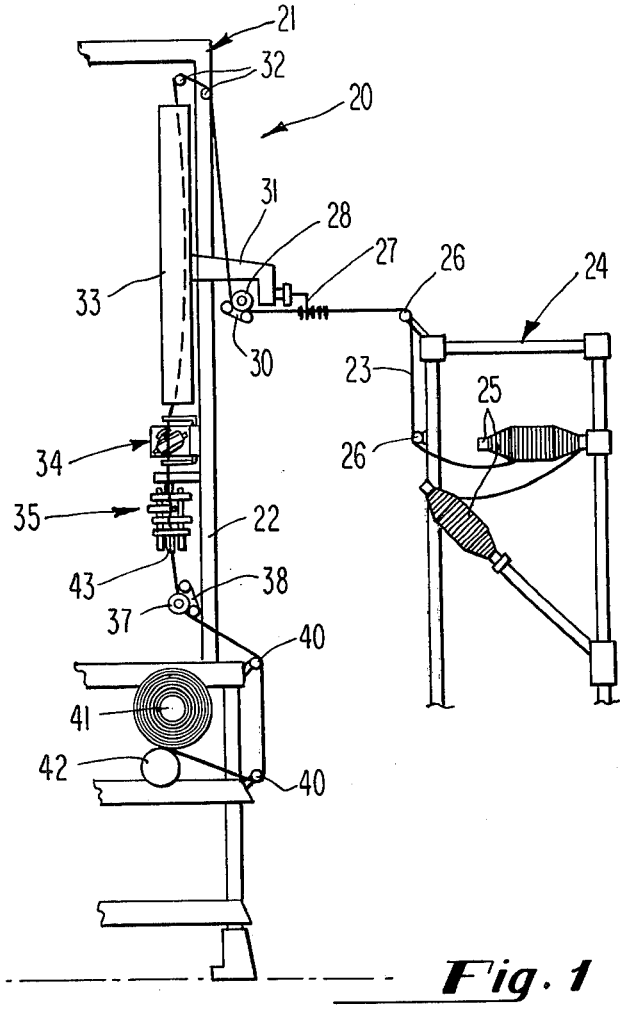
FIG. 1 is a diagrammatic elevation view of a typical false twisting apparatus in accordance with the present invention, except that the view is a fragmental illustration of a large machine employing many such twisting stations, the particular station illustrated being an end station of the machine.

Referring now to the drawings now in detail, reference is first made to FIG. 1, wherein an end station 20 of a multiple-station machine 21 is illustrated, it being understood that all stations will be similarly constructed, and for the sake of clarity and to avoid duplicity, a plurality of similar stations for the multiple station apparatus 21 are not specifically illustrated herein. Also, the illustration of FIG. 1 is somewhat schematic, especially as regards the delivery of yarn to the station, for purposes of clarity, it being understood that the yarn delivery may on occasion be of more compact, less spread-out type, in commercial machines.

The machine 21 employes an upstanding structural support 22, to which most of the components are mounted.

Synthetic yarn 23 is delivered from a suitable yarn supply generally designated by the numeral 24, that employs spindle-mounted yarn supplies 25, that may be one or more in number, for delivery of the yarn 23 over appropriate guides 26 to the station 20.

It will be understood that more than one yarn 23 may be desired to be treated together by the station 20, and to that end, an appropriate spindle arrangement (not shown) may also be utilized, bringing that yarn together with the yarn 23, at a guide 26, for example. Throughout this application, where the twisting or treating of a yarn 23 is addressed, it will be understood that such yarn 23 may, if desired, be a composite of more than one yarn.

The yarn 23 then passes through a tensioning guide 27 to a feed roll 28, including a feed roll apron 30, all appropriately mounted on mounting arm 31, to heater supply guides 32, and then through an elongated heater 33. After leaving heater 33, the yarn passes through a monitoring device 34, that is described in greater detail with reference to the illustrations of FIGS. 8 through 11, and then through a twist-applying device or twisting head 35, which is described in greater detail with reference to the illustrations of FIGS. 2 through 6, to be delivered to take-up roll 37 and its companion apron 38, to be then delivered passed guides 40, to a driven roll 41 that in turn is driven by a drive roll 42, fo accumulation onto the roll 41. It will be apparent from the illustration of FIG. 1 that all of the components are appropriately mounted on the support member 22, or to a member carried thereby.

In operation, yarn at a preselected tension controlled by tensioning guide 27 is false twisted as it passes through the device 35. Twist travesl back in a thread line to guides 32. The yarn being treated is generally thermoplastic, and is twisted about its axis as it passes through the elongated heater 33, which causes a slight melting or softening of the yarn so that upon cooling of the yarn as it leaves the heater 33, the false twist in the yarn remains as a permanent deformation in the yarn, thus giving the yarn a textured effect.

Figure 2:
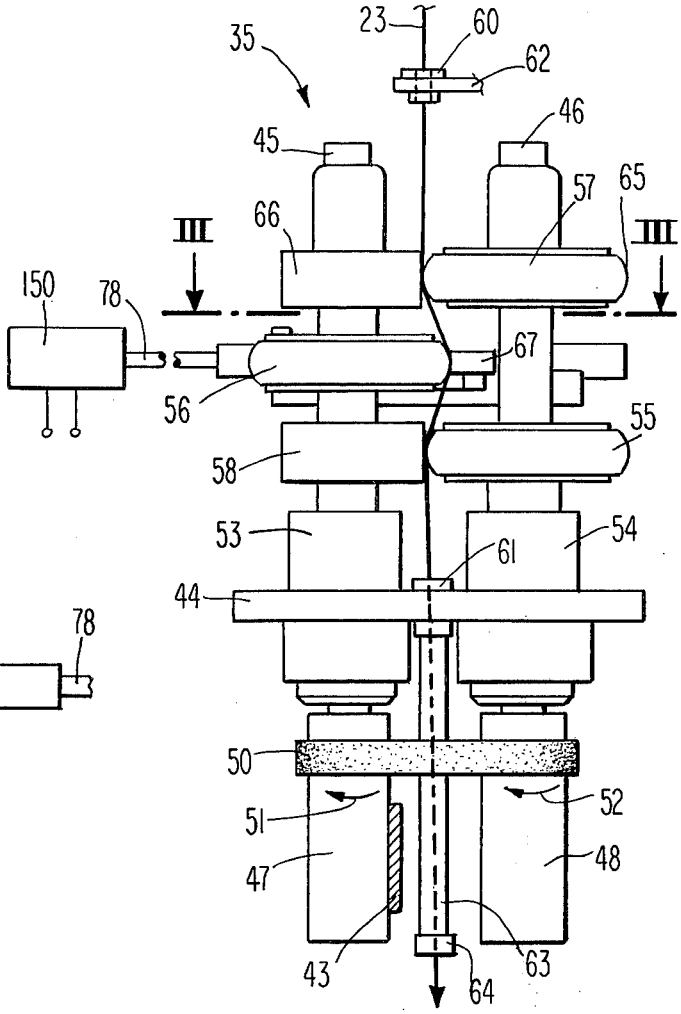
FIG. 2 is a side elevational view of a friction twisting head in accordance with this invention, embodying the twist adjustment feature, and with a schematic illustration of the means for automatically effecting the twist adjustment.

In machines of the friction twisting type, the motion of the false twist head is supplied by an endless belt member 43, passing along all of the stations of the machine. With reference to FIG. 2 in particular, the device 35 is shown as being of the type employing a single thread line per station, although it will be understood that a pair of thread lines per station may be utilized, essentially employing devices that are basically duplicates of the arrangement illustrated in FIG. 2.

In the device of FIG. 2, it is seen that the device 35 includes a mounting member 44 and generally horizontally arranged, for mounting a pair of shafts 45 and 46. The shafts 45 and 46 have lower extensions 47 and 48, respectively, with extension 47 being adapted for driving by a moving belt 43 that traverses all stations of the machine, as aforesaid. A timing belt 50 is provided although the driving means can be of any suitable type, as desired, for driving the extensions 47 and 48, and therefor the shafts 45 and 46, in the same direction indicated by the arrows 51 and 52. Thus, the two shafts 45 and 46 are rotated in unison. It will be noted, as indicated in above-mentioned application Ser. No. 478,599, filed June 12, 1974, an additional pair of shafts may be provided, to have a double yarn twisting station, if desired. However, for the purpose of describing this particular embodiment, a single mechanical yarn treatment station is illustrated in FIGS. 2 through 6.

These shafts 45, 46 are therefor freely rotatable within bearing members 53, 54, and drive the friction-inducing disks or members 55, 56 and 57 in the directions indicated by the arrows 51 and 52.

Moving friction member 55 therefor forms a barrier with an idler disk or anvil 58 mounted for non-driven idling rotation about shaft 45. It will be noted that the members 55 and 58 form a barrier therebetween, through which the yarn 23 cannot pass, although the sleeve-type hollow ceramic guide members 60 and 61 guide the yarn into a path that urges the yarn at the barrier formed by the members 55 and 58, into the barrier such that the yarn is biased toward the high friction member 55 and in abutment with the mating low friction or anvil member 58. Thus, while the direction of rotation for the shafts 45 and 46 may be altered, in all instances, the direction of rotation is such that the yarn is biased toward the friction members, so that the surface movement thereof tends to drag the yarn away from the barrier formed by an associated anvil member 58.

The guides 60 and 61 which could alternatively be of the idler pulley type, if desired, are mounted respectively on suitable mounting brackets or members 62 and 44, as illustrated. The lower end of the guide 61 is provided with a balloon tube 63, also with a hollow or sleeve-like ceramic guide 64 at the lower end thereof for passing yarn from top to bottom there-through.

On the same shaft 46 as the friction member 55 resides, a friction member 65 resides, forming a barrier with another lower friction or anvil member 66.

On the shaft 45, and also driveable thereby, the higher friction member 56 forms a barrier with an adjustable anvil or lower friction member 67.

It will be apparent that the several barriers formed herein may be a slight space, less than the thickness or diameter of the yarn 23, but preferably will not be any space, in that the friction member and its associated anvil will be in abutment, and most preferably, in interference fit one with the other, under some predetermined load, however slight.

It will noted that the yarn 23 has a path of travel defined by the guide member 60, the guide member 61, and by the fixed barrier formed by the moving friction drive member 57 and its associated anvil 66 at the inlet of the yarn 23 to the adjustably positionable barrier, and with the yarn path being defined at the outlet, or downstream of the adjustably positionable barrier by the barrier formed by the moveable high friction member 55 and its associated anvil or lower friction member 58. Ordinarily, with specific reference to FIG. 5 then, the yarn path for the yarn 23 will take the form indicated by the full line yarn path illustrated. The dotted line alterntives 70 and 71 to the full line yarn path illustrated, are available depending upon the positioning of the adjustable anvil or back-up member 67, inasmuch as the same is moveable in an arcuate direction around its associated friction member or twist-inducing member 56, in the direction as indicated by the double headed arrow 72 in FIG. 5.

The anvil member 67 comprises an idler wheel suitably carried on a carrier member on carrier plate 73 (FIG. 3), that is an extension of a kidney-shaped plate 74 having an arcuate slotted hole 75 therein.

An infinite adjustment is provided for the plate 74, for arcuate movement about the post portion 76 that functions as a fulcrum (part of post 77), an amount permitted by the arcuate slotted hole 75. As the plate 74 is moved arcuately, the roller 67 moves into contact with a different portion of the periphery of the high friction member 56, such path of adjustment of the roller 67 being generally transverse to the direction of travel of yarn 23 through the device 35.

Figure 4:
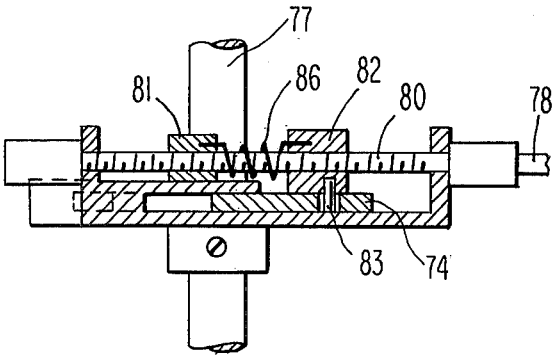
FIG. 4 is a vertical section through the adjustment feature illustrated in FIG. 3, taken generally along the line IV—IV of FIG. 3.
Figure 4A:
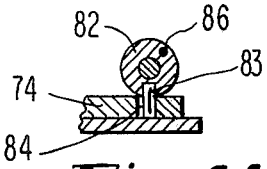
FIG. 4A is a transverse sectional view taken generally along the line IVA—IVA of FIG. 3, wherein certain components of the spring baising of the adjustment feature are better illustrated.

The infinite adjustment within the limits permitted by the slotted hole 75 is provided as follows. By rotation of a shaft 78, the threaded member 80 also rotates. Sliding block 81 is rectangular in transverse cross-section through the threaded member 80, and therefore has a rectangular lower surface that is in sliding engagement with the upper surface of the plate 74. Therefore, as the threaded member 80 is turned, the slidable mounting block 81 moves rightward or leftward as viewed in FIGS. 3 and 4, along the threaded member 80. Similarly, the sleeve-like member 82 is in threaded engagement with the threaded member 80. With particular reference to FIG. 4A, it will be noted that a pin 83 is in press-fit engagement in the lower periphery of member 82, with the pin being loose engagement in a clearance hole 84 in number 74. With the pin 83 so engaged between the members 74 and 82, rotation of the threaded member 80 causes travel, of the sleeve-like member 82 along the threaded member 80, like the member 81, except for the "play" in rotation permitted by the loose fit of the pin 83 in the oversized hole 84. Therefore, rotation of the shaft 78 will move both of the members 81 and 82 rightward or leftward depending upon the direction of rotation of the threaded member 80. As the member 82 is moved either rightward or leftward, the pin 83 is also moved in a like direction and exerts a force on the kidney-shaped plate 74 that moves that portion of the plate 74 having the oversized hole 84 therein, also either rightward or leftward, in the same direction as the sleeve-like member 82, thereby causing the post portion 76 to function as a fulcrum in engagement with another portion of the slotted hole 75, and thereby causing the adjustable anvil or roller 67 to engage the periphery of the friction member 56 at a different location as a force head, with respect to the description relating to FIG. 5.

Figure 3:
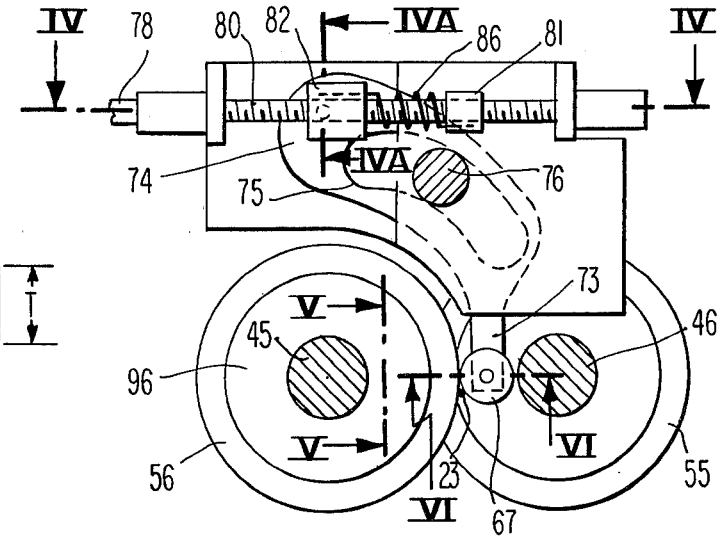
FIG. 3 is a transverse sectional view taken generally along the line III—III of FIG. 2, wherein certain components of the spring biasing of the adjustment feature are better illustrated along with illustrations of the manner of adjustment of the laterally moveable anvil member.

Provision is also made for assuring spring type engagement of the anvil member 67 against the periphery of friction member 56. To this end, a torsion spring 86 is provided, disposed about the threaded member 80, as illustrated in FIGS. 3 and 4, with one end imbedded in member 81 and the other end imbedded in member 82. The spring 86 is wound in such a direction as to tend to rotate the sleeve-like member 26 in a counterclockwise direction as viewed in FIG. 4A, and thereby keeps the pin 83 in tight engagement with the right side of the clearance hole 84 illustrated in FIG. 4A, thereby tending to provide a force on the plate 74 at the location of the hole 84 that is in an upwards or lifting direction as viewed in FIG. 3, which therebyprovides a clockwise force on the movement of the plate 74 about the fulcrum 76, that keeps the roller or anvil 67 in spring-urged engagement against the surface of the friction member 56.

Figure 5:
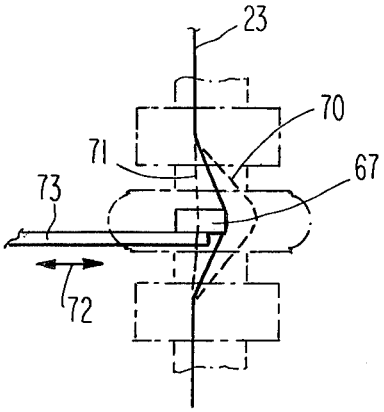
FIG. 5 is a schematic view illustrating the manner in which the barrier movement effected by adjustment of the anvil position will effect an alteration in the path of yarn movement for providing different degrees or amounts of wrap of the yarn about the twist-inducing member.

In operation, therefor, it can be seen that if it is desired to obtain an additional amount of contact of the yarn 23 with the several friction members 57, 55, 56, and most especially with the friction member 56 that has the adjustable member 67 associated therewith as a set, the shaft 78 may be turned, in such a direction as will allow the anvil 67 to move in an arc about the periphery of the associated friction member 56 as allowed by the plate 74 with the slotted hole 75 moving relative to the pin 76, such that the barrier formed between the anvil 67 and the friction memmber 56 is moved transversely, or laterally as indicated by the double-headed arrow 72 in FIG. 5, transverse to the general solid line path of travel of the yarn 23 illustrated therein, to the position indicated by the alternative dotted line path portion 70 of FIG. 5, if desired. Conversely, if less twisting of the yarn is desired, and consequently less amount of contact of the yarn 23 about the several friction members, an appropriate rotation of the shafts 78 will withdraw the adjustable anvil 67 leftward as viewed in FIG. 5, such that the yarn path approaches the dotted line path portion 71 illustrated in FIG. 5. It will thus be understood that such alternatives in the degree of wrap of yarn about the friction members produce corresponding alterations in the degree or amount of yarn twist. By providing an adjustment means for each yarn 23, in a multiple-station machine, each of the yarns may be adjusted during its running as it enters the twist-inducing device 35, an amount determined by discrepancies from the desired amount or degree of twist, as detected by the monitoring device 35, such adjustment being made automatically by virtue of an operational tie-in between the shaft 78 and the monitoring device 34, as will be described in more detail hereinafter. Thus, lack of uniformity that produces undesirable fabric characteristics, such as dye streaking, can be reduced or eliminated, as desired, and such may be done on a position-to-position basis, with the adjustments being made automatically, independent of any other station or position.

It will be noted that, in accordance with this invention, either of the high friction members or anvil members may be the adjustable components. However, because the anvile 67 is essentially an idler member, it becomes less complex to effect the adjustment by moving the member 67. However, any suitable means for moving the barrier formed thereby as indicated herein should also accomplish the same result. Also, it will be noted that while in the apparatus illustrated in FIG. 2, three different sets of friction members and anvils for forming the three different barriers are indicated, in many instances, it may be desired that only a single set 56, 67 would be employed. Furthermore, it will be clear that, if additional adjustment is desired, other anvils could be of the type 67. In this regard, reference is made to FIG. 7.

Figure 7:
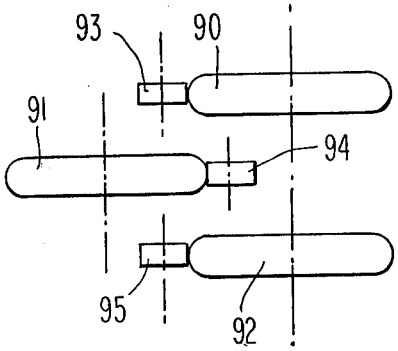
FIG. 7 is a schematic illustration of a modified arrangement of twist-applying and back-up members in accordance with this invention.

In FIG. 7 a modified schematic arrangement of three high friction members 90, 91 and 92 is illustrated, each mounted on an appropriate shaft of the type illustrated in FIG. 2, but wherein the anvils or lower friction members 93, 94 and 95 are of the smaller diameter type of roller 67. It will be noted that while at least the anvil member 94 should preferably be adjustable, either of the anvils 93 or 95 could also be adjustable. In most instances, however, the members 93 and 95 would be mounted for rotational movement on shafts (not shown) having centers of rotation closer to the center of rotation for the members 90 and 92, than the center of rotation of the member 91, although such mountings may be fixed rather than of the transversely adjustable type of the mounting for the anvil member 94 in the preferred embodiment.

Moreover, additional sets of friction members and anvils, such as four or five sets or more could be added rather than the three sets illustrated in the device in FIG. 2.

It will also be apparent that within the broad context of this invention, other means for adjusting the barrier than the specific threaded arrangement illustrated in FIGS. 3 and 4 could be provided.

Also, other alternatives to the anvils 66 and 58 may be utilized, as are disclosed in the above-mentioned parent application Ser. No. 478,599, filed June 12, 1974 and incorporated by reference herein.

Figure 6:
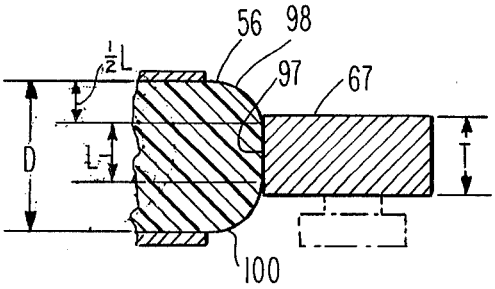
FIG. 6 is an enlarged fragmentary sectional view taken through the twist-applying and back-up members in accordance with this invention, taken generally along the line VI—VI of FIG. 3.

With particular reference to FIG. 6, a detailed construction of the anvil member 67 and the high friction wheel or member 56 is illustrated. The anvil member 67 is generally of steel construction. The member 56 will comprise a wheel 96 having a surface material thereon that will have certain rubber-like or high friction characteristics, but preferably will be of synthetic, for example, nylon, polyproplene or the like rubber construction. A preferred configuration will be one that employs a "flat" 97 on the periphery, that defines upon revolution of the member 56, a cylindrical surface of revolution, that has a length "L" as measured in the axial direction that is approximately one-half the distance "D" across the high friction portion of the member 56, and that is disposed intermediate curved portions 98 and 100, each of which are one-half "L" in axial dimension, and with the thickness "T" of the anvil 67 being slightly greater than the dimension "L".

This arrangement and details of construction for the high friction member 56 as described with respect to FIG. 6 represent the preferred form of such high friction member, and by making the thickness "T" of the anvil member 67 approximately as described relative to the flat portion 97 of the wheel 56, excessive build-up of yarn finish does not generally occur.

Figure 8:
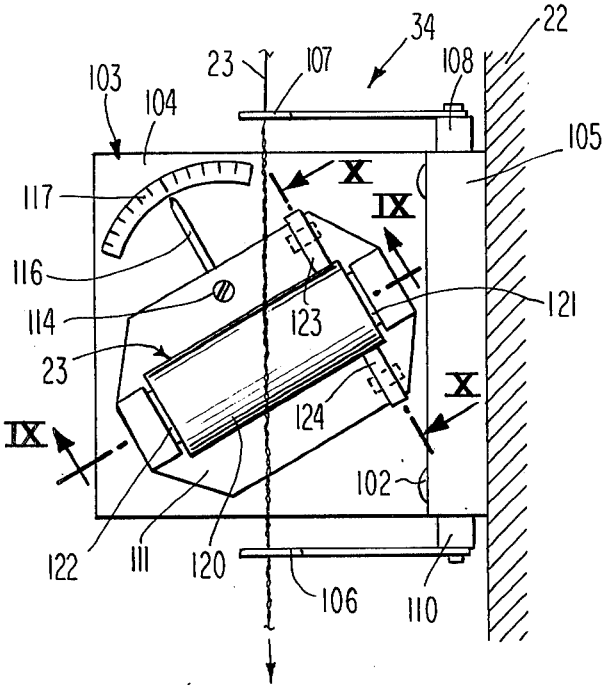
FIG. 8 is an enlarged vertical illustration of the monitoring device of the present invention mounted on the upstanding support as illustrated in FIG. 1.
Figure 9:
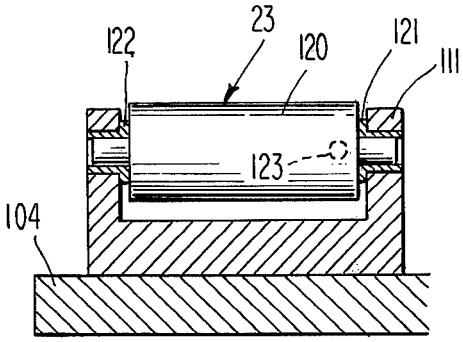
FIG. 9 is a sectional view, taken through the arcuately moveable roller and its end mounting arrangement of FIG. 8, generally along the line IX—IX of FIG. 8.
Figure 10:
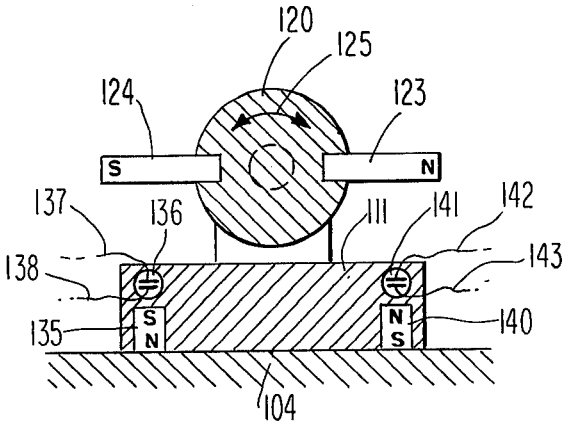
FIG. 10 is an enlarged sectional view, taken through the arcuately pivotal roller and magnet arrangement illustrated in FIG. 8, generally along the line X—X of FIG. 8.

With reference now to FIGS. 8 through 10 in detail, wherein the monitoring device 34 is specifically illustrated, it will be seen that the device 34 is mounted on the upstanding structural support 22 by any suitable means, such s by screws 102 or the like. The device 34 includes a L-shaped member 103 comprising an outwardly extending leg 104 and another leg 105 at right angle thereto, the leg 105 being secured to the upstanding member 22 by means of the fasteners 102, with yarn guides 106 and 107 carried on spacers 108 and 110 that in turn are mounted to the member 103.

A roller mount 111 is provided, carried by the leg 104 of the support 103, and with respect to which the member 111 is pivotally mounted with the screw 114 extending into leg 104 through the member 111. Thus, the member 111 is pivotally mounted relative to the base 104.

Figure 8A:
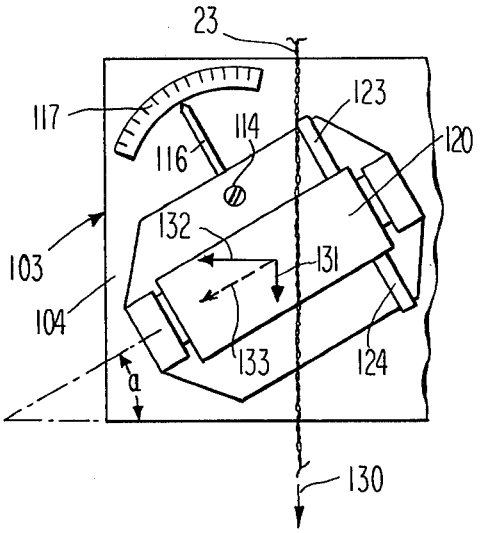
FIG. 8A is a fragmental illustration of a portion of the monitoring device illustrated in FIG. 8, with certain components omitted for the sake of clarity, and wherein the force diagram of yarn forces on the arcuately moveable member are better illustrated.

A locking means is provided in the form of the screw fastener or the like 114 engaged as illustrated in FIG. 8, and in threaded engagement (not shown) in the support leg 104, whereby member 111 may be angularly disposed by moving it such that an indicator 116 mounted thereon and fixedly carried thereby may be oriented at an angle as desired, and then fixed at the angle to indicate a predetermined and preselected helix angle, which also corresponds to the number of turns per inch of desired twist to be applied to the yarn 23. The fixed angle may subsequently be fixedly adjusted to any other desired angle. The graduation member 117 is thus mounted with appropriately numbered graduations. The mounting device 111 will therefor be oriented at an angle "*a*" as indicated in FIG. 8A to correspond to the desired amount of twist as indicated by the indicator 116 pointing to a desired numbered graduation on the scale 117.

The arcuately moveable member 120 is mounted for pivotal movemnt in suitable bearings 121 and 122 that in turn are carried by the member 111 as illustrated in FIG. 9, for freedom of pivotal movement therein, with the bearings 121 and 122 being of the very low friction type.

A pair of magnets of the permanent type, 123 and 124 are provided, imbedded in the periphery of the roller type arcuately moveable member 120 as illustrated in FIG. 10, and are adapted for movement of the member 120 in either the clockwise or counter-clockwise direction as indicated by the double headed arrow 125 of FIG. 10.

It will thus be seen that the member 120 is adapted for a slight degree of pivotal movement in either direction as viewed in FIG. 10. Yarn 23 is delivered along its path of travel, across the upper surface of the member 120 as illustrated in FIG. 8A, which yarn 23 exerts a resultant force on that portion of the roller 120 that it engages, that is a composite of the longitudinally moveable force (downward) as indicated by the arrow 130 in FIG. 8A and that is represented by the vector arrow 131, as well as a rotational force that is represented by the vector arrow 132, the resltant being indicated by the vector arrow 133. Desirably, this resultant vector 133 of force being applied to the roller 120 by the yarn 23 will be along the axis of pivot or arcuate movement of the roller 120, which will correspond to the pre-set angle "a".

Figure 8B:
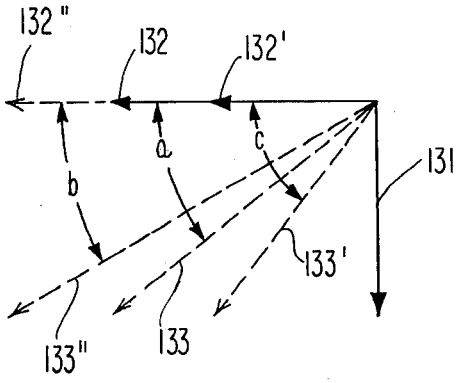
FIG. 8B is a composite of a plurality of force vector diagrams.

With reference to FIG. 8B, if the twisting component of force exerted by the yarn 23 on the roller 120 is too little, the force vector in the direction of the vector 132 will be reduced, because of a reduction in twisting force in that direction, to an amount represented by the arrow 132', such that its resultant will be represented by the force vector 133', tending to rotate the roller 120 in a counter-clockwise direction as viewed in FIG. 10, such that south pole of the magnet 124 will approach the south pole of the permanent magnet 135 indicated in FIG. 10, imbedded in the base of the member 111, whereupon the magnet field increased thereby will cause the reeds of the reed switch 136 to engage each other, and complete the circuit between the leads 137 and 138.

Similarly, but oppositely, if the twisting component of forc exerted is too great, the force applied thereby, as represented by the vector 132'' causes a resultant force vector 133'' that tends to pivot the roller member 120 in a clockwise direction as view in FIG. 10, such that the north pole of the magnet 123 approaches more closely the north pole of the magnet 140 imbedded in the member 111, thereby closing the reed switch 141 and completing the circuit between the leads 142 and 143 thereof.

It will be apparent that if the twist is operative in an opposite direction, the force vectors illustrated in FIGS. 8A and 8B will be oppositely directed, and that the force vector representations in FIGS. 8A and 8b are for purposes of illustrating the concept only and not theprecise direction of force application as induced by the direction of twist of the yarn 23. It will therefore be apparent that the direction of the force vectors will vary according to the direction of twist being applied, but that the concept demonstrates that the roll 120 sees on its surface sliding forces exerted by the longitudinal movement of the yarn 23 thereover,and rotational forces caused by the amount of twist in yarn applied thereto. While the longitudinally-induced forces (vector 131) will generally remain constant in that they correspond to thru-put speed of the yarn (take-up speed of the machine), the rotationally-induced forces (vector 132) can vary under various factors, such as the amount of finish on the yarn 23 being treated, wear of components such as high friction rollers and the like, and the device of this invention is designed to compensate therefor. It will thus be seen that what is accomplished, is that there will be no automatic correction when there is a perfect balance of hese forces on the roll 120, but that when such forces become out of balance by some predetermined amount, such that the resultant forces approach the force vectors 133' or 133'', due to an undesired increase or decrease in the desired amount of twist, the corresponding pivotal movement of the roller member 120 in an arcuate manner, in either a counter-clockwise or clockwise direction will cause completion of the circuit through either of the reeds switches 136 or 141. The tolerable variance before the circuit is completed may be pre-set depending upon the strength of the magnets 123 and 124, their placement away from the reed switches 136 and 141, the pre-selected resistance of the reed switches 136 and 141 to closing, and whether or not magnets 135 and 140 (optional) are utilized, and the strength of those magnets 135 and 140. Thus, the degree of tolerable variation may be predetermined.

Figure 11:
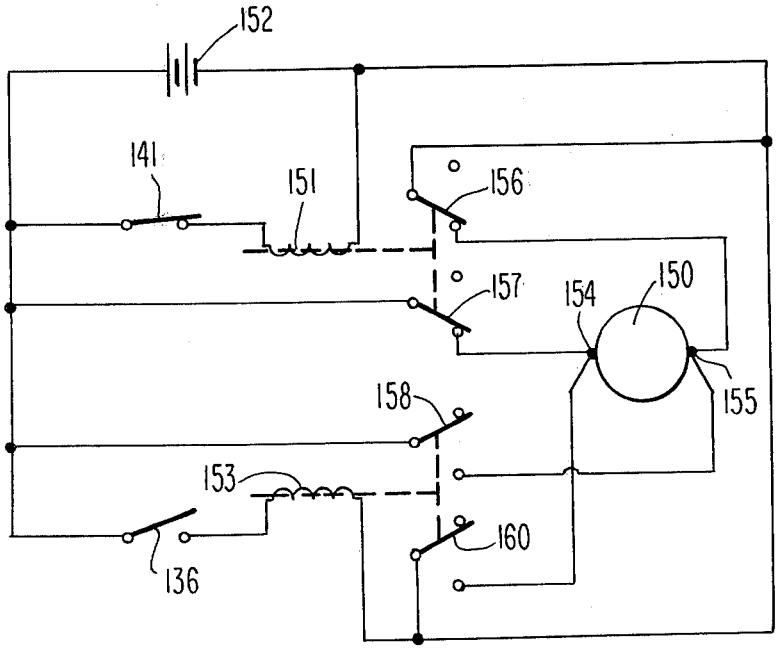
FIG. 11 is a schematic of the switch circuitry, of the monitor illustrated in FIG. 8.

With reference now to FIG. 11, it will be apparent that a switching circuit is provided whereby the polarity applied to the motor 150 may be altered in accordance with the pivoting of the roller member 120 and the arms 123 and 124 as set forth in FIG. 10. A pair of reed switches 136 and 141 is conjunctively operated by these magnets 123 and 124, such that one or the other of the switches 136 and 141 is open and the other is closed. Closure of switch 141 energizes a relay coil 151 by connecting it across the power supply 152. Alternatively, closure of switch 139 energizes another relay coil 153 by connecting it across the power supply 152. The various switch contacts which are controlled by the coils 151 and 153 serve to alter the polarity of the motor 150 by reversing the connection of its input terminals 154 and 155 and respect to the power supply 152. In particular, coil 151 controls a pair of switch contacts 156 and 157, and coil 153 controls a pair of swtich contacts 158 and 160. It may seem that, depending upon the condition of the reed switches 136 and 142, either switches 156 and 157 are both closed and switches 158 and 160 are both open, or alternatively switches 156 and 157 are both open and swtiches 158 and 160 both closed. Closure of switches 156 and 157 couples input terminal 154 of motor 150 to the positive terminal of power supply 152 and input terminal 155 of motor 150 to the negative terminal of the power supply 152. Conversely, closure of switches 158 and 160 couples terminal 154 of motor 150 to the negative terminal of the power supply 152 and terminal 155 of motor 150 to the positive terminal of the power supply 152. Hence, closure of reed switch 141 renders terminal 154 positive and terminal 155 negative, and closure of reed switch 136 renders terminal 154 negative and terminal 155 positive. It will therefor be seen that a given degree of pivotal or arcuate movement of the arcuately moveable member 120, after moving a predetermined amount determined by the setting, strength, etc., of the magnets 123, 124, the settings of the switches 136 and 141, and by the magnets 135 and 140, causes acutation of the motor 150 (preferably a constant speed motor), to cause rotation of the shaft 78 in one direction or the other, to thereby cause movement of the anvil member 67 in either a rightward or leftward direction as indicated by the double headed arrow 72 in FIG. 5, and to thereby cause lateral displacement of the path of travel of the yarn 23, through the friction twisting apparatus 35 an amount to compensate for the degree, or amount of deviation of twist being applied to the yarn 23 by the high friction surface twist-appling member 56 of the barrier-forming pair of members 56 and 67. This, of course, effects a variance or alteration in the degree of or amount of twist of the yarn 23, by altering the amount of contact of the yarn 23 with the friction-applying member 56 as aforesaid.

It will be apparent from the foregoing that particular materials of construction and configurations of the various devices may vary within the context of the present invention. For example, the material of construction of the high friction members may vary to other configurations, although a preferred configuration is presented herein. Also, while the adjustable feature of this invention is illustrated in a machine that contemplates an essentially vertical yarn path, it is to be understood that horizontally disposed yarn paths, such as that disclosed in U.S. Patent No. 3,705,488 could also embody the features of the present invention as regards adjustability and monitoring, as could other arrangements in which an alteration of a portion of the path of the yarn that induces a different amount of contact of yarn about a friction twist-inducing member be satisfactory, as could variations in the utilization of the concept of monitoring as taught herein. It will also be apparent that other modifications may be made in the details of constructions, as well as in the use and operation of the devices of the present invention, or within the spirit and scope of the invention as defined in the appended claims.

What is claimed is:

1. In yarn false twisting wherein yarn travles along a predetermined path and has twist applied thereto, the process of obtaining improved twist uniformity by the steps of a. continuously applying twist to yarn travelling along its path;

b. continuously monitoring the amount of twist in yarn travelling along the path by i. first setting the axis of an arcuately moveable member at a predetermined fixed angle with the yarn path, the fixed angle corresponding to the desired amount of twist in the yarn, and ii. then sliding the yarn over the arcuately moveable member, iii. detecting a deviation from the desired amount of twist in the yarn as a function of an imbalance of forces resulting from longitudinal and rotational movement of the yarn relative to the arcuately moveable member as expressed by arcuate movement about its axis of the moveable member while maintaining said set angle fixed, and c. adjusting the amount of twist being applied to yarn travelling along the path in response to the movement of the movable member, in compensation for the deviation in amount of twist so detected.

2. The process of claim 1, wherein the step of continuously applying twist comprises friction twisting.

3. The process of claim 2, wherein the friction twisting step includes the yarn in a barrier between a rotating high friction member and a lower friction member disposed in opposition to the high friction member.

4. The process of claim 3, wherein the adjusting is automatic and in direct response to the arcuate movement of the movable member reaching a predetermined magnitude, wherein the yarn travels along a longitudinal path having a lateral displacement therein, and wherein said adjusting includes varying the amount of lateral displacement of the moving yarn by lateral movement of the lower friction member.

5. The process of claim 1, wherein the adjusting is automatic and in direct response to the arcuate movement of the movable member reaching a predetermind magnitude.

6. The process of claim 1, wherein the yarn travels along a longitudinal path having a lateral displacement therein, and wherein said adjusting includes varying the amount of lateral displacement of the moving yarn.

7. In yarn false twisting on a production basis, wherein a plurality of yarns travel each along its predetermined path and wherein each has twist applied thereto along its path at its own twist-applying station, the process of obtaining improved twist uniformity from station-to-station by the steps of a. continuously applying twist to each of the yarns as they travel along their paths, b. regularly monitoring separately the amount of twist in each yarn travelling along its path to detect deviations in the amount of twist from the desired amount of twist, separately with respect to each of the yarns, and c. adjusting independently of any other station the amount of twist being applied at any station having an unacceptable amount of twist being applied thereat, in response to and in compensation for a deviation from the desired amount of twist as detected during the monitoring.

8. The process of claim 7, wherein the monitoring at each station is continuous.

9. The process of claim 7, wherein the adjusting is automatic and in direct response to the detected deviation from the desired amount of twist.

10. The process of claim 7, wherein the monitoring step at each station is continuously accomplished with respect to the yarn path at each station by separately and independently:

a. first setting the axis of an arcuately moveable member at a predetermined fixed angle with the yarn path, the fixed angle corresponding to the desired amount of twist in the yarn, and b. then sliding the yarn over the arcuately moveable member, c. detecting a deviation from the desired amount of twist in the yarn as a function of an imbalance of force resulting from longitudinal rotational movement of the yarn relative to the arcuately moveable member as expressed by arcuate movement about its axis of the moveable member while maintaining said set angle fixed.

11. The process of claim 10, wherein the adjusting is automatic and in direct response to the arcuate movement of the movable member reaching a predetermined magnitude.

12. The process of claim 11, wherein the yarn travels along a longitudinal path having a lateral displacement therein, and wherein said adjusting includes varying the amount of lateral displacement of the moving yarn.

13. Apparatus for use in yarn false twisting for obtaining improved twist uniformity comprising means defining a predetermined path of yarn travel, means for continuously applying twist to yarn travelling along the path, means for monitoring the amount of twist in yarn travelling along the path, said monitoring means including:

a. an arcuately moveable member having an axis of movement that is fixedly disposed at a predetermined fixed angle with the yarn path, which angle corresponds to the desired amount of twist in the yarn, and said moveable member being mounted at said angle for sliding movement of yarn there over, b. means for detecting a deviation from the desired amount of twist in the yarn as a function of arcuate movement of said moveable member while said angle is fixed, and means for adjusting the amount of twist being applied to yarn travelling along said path in response to arcuate movement of said moveable member and in compensation for the deviation in the amount of twist so detected.

14. The apparatus of claim 13, wherein said means for applying twist comprises friction twisting means.

15. The apparatus of claim 14, wherein said friction twisting means comprises at least one pair of rotatable barrier members, with one member of the pair comprising a high friction member and the other member comprising a low friction member disposed in opposition thereto, sufficiently closely spaced to define therebetween a barrier through which yarn being twisted cannot pass.

16. The apparatus of claim 13, wherein said arcuately moveable member comprises a roller, pivotally moveable about an axis.

17. The apparatus of claim 13, wherein said means for detecting comprise switch means mounted relative to said arcuately moveable member and operatively connected to said adjusting means, and including means for automatically actuating said switch means upon a predetermined arcuate movement of said pivotally moveable member in either a clockwise or counterclockwise direction, in direct response to arcuate movement of said arcuately moveable member.

18. The apparatus of claim 17, wherein said means for actuating comprise magnet means carried by said arcuately moveable member for movement therewith for inducing a magnetic field of strength that varies with the arcuate movement of the moveable member and wherein said switch means are of the magnetic-field-responsive type.

19. The apparatus of claim 18, wherein said adjusting means includes a reversible motor adapted for rotation in either direction, and said switch means is operably connected thereto for driving the motor in a given direction depending upon the direction of and amount of arcuate movement of the arcuately moveable member.

20. The apparatus of claim 17, wherein said means for applying twist includes a rotatable high friction member for engagement with yarn travelling along the path and said adjusting means includes means for varying the lateral displacement of yarn moving along its path at the location of said high friction member.

21. The apparatus of claim 20, wherein said high friction member defines a barrier with a lower friction member through which yarn will not pass, and said means for varying the lateral displacement comprises means for moving the lower friction member and said barrier to increase the amount of contact of yarn with said high friction member.

22. The apparatus of claim 21, wherein said means for actuating comprise magnet means carried by said arcuately moveable member for movement therewith for inducing a magnetic field of strength that varies with the arcuate movement of the moveable member and wherein said switch means are of the magnetic-field-responsive type, wherein said adjusting means includes a reversible motor adapted for rotation in either direction, and said switch means is operably connected thereto for driving the motor in a given direction depending upon the direction of and amount of arcuate movement of the arcuately moveable member, and wherein said means for varying the lateral displacement comprises said motor.

23. Apparatus for use in false twisting yarn on a production basis for obtaining improved twist uniformity from station-to-station, comprising means defining a plurality of separate predetermined paths of yarn travel, each path having its own twist-applying station, means for applying twist to each of the yarns as it travels along its path, means for regularly monitoring separately the amount of twist in each yarn travelling along its path to detect deviations in the amount of twist from the desired amount of twist, separately with respect to each of the yarns, and means for adjusting independently of any other station the amount of twist being applied at any station having an unacceptable amount of twist being applied thereat, in response to and in compensation for a deviation from the desired amount of twist as detected by said monitoring means.

24. The apparatus of claim 23, wherein said monitoring means comprises continuous monitoring means.

25. The apparatus of claim 23, wherein said adjusting means comprises automatic adjusting means operable in response to a deviation from a desired amount of twist.

26. The apparatus of claim 23, wherein said monitoring means comprises continuous monitoring means and includes at each said station:

a. an arcuately moveable member having an axis of movement that is fixedly disposed at a predetermined fixed angle with the yarn path, which angle corresponds to the desired amount of twist in the yarn, and said movable member being mounted at said angle for sliding movement of yarn there over, and b. means for detecting a deviation from the desired amount of twist in the yarn as a function of arcuate movement of said moveable member while said angle is fixed.

27. The apparatus of claim 26, wherein said means for applying twist comprises friction twisting means, and wherein said means for detecting each comprise switch means relative to said arcuately moveable member and operatively connected to said adjusting means, and including means for automatically actuating said switch means upon a predetermined arcuate movement of an associated said pivotally moveable member in either a clockwise or counterclockwise direction, in direct response to arcuate movement of said arcuately moveable member.

28. The apparatus of claim 27, wherein said means for applying twist includes a rotatable high friction member at each said station, for engagement with yarn travelling along the path, and with said adjusting means at each said station including means for varying the lateral displacement of yarn moving along its path at the location of said high friction member, for adjusting the amount of contact of yarn at that station with its associated said high friction member.

29. In an apparatus for applying twist of some type to yarn or the like, a means for monitoring the amount of twist in the yarn, said monitoring means including an arcuately moveable member having an axis of movement that is adapted to be fixedly disposed at a predetermined fixed angle with the yarn path, which angle corresponds to the desired amount of twist in the yarn, and with said moveable member being adapted for disposition at said angle for a sliding movement of yarn thereover, and including means for detecting a deviation from the desired amount of twist in the yarn as a function of arcuate movement of said moveable member.

30. The monitoring apparatus of claim 29, wherein said arcuately moveable member comprises a roller, pivotally moveable about an axis.

31. The monitoring apparatus of claim 29, wherein said means for detecting comprise switch means mounted relative to said arcuately moveable member, and including means for automatically actuating said switch means upon a predetermined arcuate movement of said pivotally moveable member in either a clockwise or counterclockwise direction, in direct response to arcuate movement of said arcuately moveable member.

32. The apparatus of claim 31, wherein said means for actuating comprise magnet means carried by said arcuately moveable member for movement therewith for inducing a magnetic field of strength that varys with the arcuate movement of the moveable member and wherein said switch means are of the magnetic-field-responsive type.

33. A method of monitoring the amount of twist in yarn traveling along a predetermined path by i. first setting the axis of an arcuately moveable member at a predetermined fixed angle with the yarn path, the fixed angle corresponding to the desired amount of twist in the yarn, and ii. then sliding the yarn over the arcuately moveable member, and iii. detecting a deviation from the desired amount of twist in the yarn as a function of an imbalance of forces resulting from longitudinal and rotational movement of the yarn relative to the arcuate movement about its axis of the moveable member while maintaining said set angle fixed.

* * * * *

UNITED STATES PATENT OFFICE

CERTIFICATE OF CORRECTION

Patent No. 4,015,414 Dated April 5, 1977

Inventor(s) William C. Sholly, Jr.

It is certified that error appears in the above-identified patent and that said Letters Patent are hereby corrected as shown below:

Column 3, line 54, "fo" should read -- for --.

Column 3, line 61, "travesl" should read --travels--.

Column 6, line 10, "member 26" should read --member 82--.

Column 6, line 16, "therebyprovides" should read --thereby provides--.

Column 9, line 7, "forc" should read --force--.

Column 9, line 39, "hese" should read --these--.

Column 9, line 67, "139" should read --136--.

Column 11, line 1, "travles" should read --travels--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*